US012305472B2

(12) United States Patent
Caruana

(10) Patent No.: US 12,305,472 B2
(45) Date of Patent: May 20, 2025

(54) TENSILE RELEASE MECHANISM

(71) Applicant: TCO AS, Indre Arna (NO)

(72) Inventor: Adrian Caruana, Fana (NO)

(73) Assignee: TCO AS, Indre Arna (NO)

( * ) Notice: Subject to any disclaimer, the term of this patent is extended or adjusted under 35 U.S.C. 154(b) by 0 days.

(21) Appl. No.: 18/383,549

(22) Filed: Oct. 25, 2023

(65) Prior Publication Data

US 2025/0137344 A1 May 1, 2025

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS 4,509,594 A * 4/1985 Milberger ..... E21B 33/043 285/123.3
4,580,630 A * 4/1986 Milberger ..... E21B 33/043 166/208
4,648,444 A * 3/1987 Busch ..... E21B 47/017 403/2
4,696,502 A * 9/1987 Desai ..... E21B 31/20 166/99
5,720,343 A * 2/1998 Kilgore ..... E21B 33/1293 166/134
8,322,448 B2 * 12/2012 Brandsdal ..... E21B 34/063 166/376
8,397,813 B2 * 3/2013 Brandsdal ..... E21B 33/134 166/299
9,194,205 B2 * 11/2015 Brandsdal ..... E21B 34/06
9,222,322 B2 * 12/2015 Brandsdal ..... E21B 33/12
10,655,413 B2 * 5/2020 Brandsdal ..... E21B 34/063
10,883,328 B2 * 1/2021 Brandsdal ..... E21B 29/02
11,332,999 B1 * 5/2022 Eriksen ..... E21B 33/1208
11,441,382 B1 * 9/2022 Eriksen ..... E21B 34/102
11,851,968 B2 * 12/2023 Eriksen ..... E21B 34/102
2003/0116328 A1 * 6/2003 Doane ..... E21B 33/1208 166/182
2003/0141079 A1 * 7/2003 Doane ..... E21B 33/1208 166/134
2016/0060998 A1 * 3/2016 Hiorth ..... E21B 33/1208 166/192
2017/0247988 A1 * 8/2017 Hardesty ..... E21B 43/11852
2017/0247996 A1 * 8/2017 Hardesty ..... E21B 33/1208
2017/0306711 A1 * 10/2017 Hern ..... E21B 29/06
(Continued)

*Primary Examiner* — Steven A MacDonald
(74) *Attorney, Agent, or Firm* — Flener IP & Business Law; Zareefa B. Flener

(57) ABSTRACT

The present invention relates to a plug assembly arranged in a housing, where the plug assembly comprises a glass assembly comprising a plug; a seat arranged to support the plug, a breaker object and a tensile release mechanism comprising a tensile body and a tensile element, wherein the tensile element is arranged along the tensile body, the tensile release mechanism being arranged to break at the tensile element at an applied threshold tensile force, the plug assembly being arranged to have a first position in which the plug is intact and fluid flow through the plug is blocked and a second position in which the seat has moved, the tensile element has been broken and the plug has been broken by the breaker object.

16 Claims, 9 Drawing Sheets

(56) References Cited

U.S. PATENT DOCUMENTS

| | | | | |
|---|---|---|---|---|
| 2019/0017345 | A1* | 1/2019 | Brandsdal | E21B 34/063 |
| 2020/0200516 | A1* | 6/2020 | Zemla | F42D 1/045 |
| 2020/0408065 | A1* | 12/2020 | Palmer | E21B 34/142 |
| 2022/0268360 | A1* | 8/2022 | Caruana | B23K 26/21 |

* cited by examiner

TENSILE RELEASE MECHANISM

FIELD OF INVENTION

The present invention relates to a tensile release mechanism and a plug assembly containing the same.

BACKGROUND

During the drilling, testing, completion, fracking, production, and abandonment stages of hydrocarbon wells there are many uses for plugs assemblies that create a fluid barrier in the well. Some of these uses are not permanent such as plug and abandonment, but rather temporary, where it is desired to re-establish fluid flow in the well at a later stage. Some examples of such temporary uses of plugs are for flotation, well testing during completion, packer setting and fluid loss devices.

Temporary plugs may thus be installed in any kind of piping installed downhole, for example casing, liner, or other tubing. The only difference between these is the inner diameter of the pipe.

When flow through the well is to be established, the plug is broken. This is preferably done without spearing, milling, or other mechanical intervention from the surface.

Ways to achieve the desired breaking of the plug includes the use of pressure, pressure pulses, or explosives. When the plug is removed it allows for a nonrestricted fluid flow past the opened plug assembly, and for many applications after opening of the plug assembly this is required in order to pass various tools past the plug assembly.

Plugs can be made of various materials, such as metal, stone, or composites, or more frangible materials such as glass or ceramics. Frangible materials are often preferred as they have the advantage of being relatively insensitive to pressure, temperature and chemical corrosion, yet by their frangible nature they are relatively easy to destroy when used as the fluid blocking part of plug assemblies. Particularly glass, e.g., hardened glass, can be made to break into very small pieces that will not pose a problem in most wells. Frangible materials are therefore well suited for opening the plug assembly by constructing the plug assembly with a breaker of small amounts of explosives that will crush or shatter a glass disc, and open the plug assembly, but not damage the production tubing or casing the plug assembly is installed in. Plugs can also be opened by applying direct force thereto with a breaker. The breaker will then make contact with the plug on a relatively small area. Frangible materials will typically shatter, and this property of breaking under a large point pressure load is taken advantage of by employing a breaker object with a relatively small impact area, such as a thin edge like a knife blade, a point such as a pin, or even a small ball.

A problem with many frangible materials is that they can prematurely break where they contact a hard surface such as a metal surface. This can happen when the plug is being installed or even when changes in pressure in the well causes minute movements of the glass assembly. One way to overcome this issue is to put a bearing ring of a soft material (e.g., plastics such as polyether ether ketone; PEEK) between the frangible plug and any hard surface (e.g., steel) it abuts. This allows the force on the plug to be transferred to the bearing ring instead. The bearing ring will then compress and prevent the plug from coming in contact with a hard surface. The plug should be installed in such a way that it is well secured and will not break easily from fluctuating well pressures (i.e. from direct pressure rather than from a breaker). The plug should also be secured in such a way that it forms a as fluid tight seal as the specifications of the specific application require until it is removed. Leakage of fluid between a plug tubular and the surrounding area, such as the annulus, should be prevented as far as possible.

Loose parts in the wellbore can cause a lot of damage to equipment and even obstruct the well bore. Thus, the plug should preferably break into fragments small enough to not be a potential problem in the well. The various other parts of the plug assembly should preferably be prevented from entering the wellbore when breaking the plug, so they or pieces thereof will not be a potential problem in the well. These other parts should also preferably be prevented from moving once the plug assembly is opened. There should not be a possibility of a partial opening of the plug, i.e. the system should preferably only allow for the plug to be fully intact or fully broken, not partially broken. If partially broken, it would not be possible to open fully with pressure from above since a partially open plug assembly could not be pressurized, so different means to open it fully would have to be used.

An inner diameter of the tubing the plug assembly is installed in, should preferably be fully restored upon opening of the plug assembly, i.e. the plug assembly should not have a smaller inner diameter than the inner diameter below and above the plug assembly. This allows for a nonrestricted fluid flow past the opened plug assembly, as well as unrestricted passing of tools up to the inner diameter of the pipe the plug sits in.

When a plug assembly comprises of a release mechanism in form of a shear ring that is arranged such that when a threshold pressure differential is applied to a surface of the plug, the shear ring will shear and allow for axial movement of the seat of the plug assembly.

The shear ring comprises a retaining lip, wherein the retaining lip is arranged such that it prevents movement of the frangible materials of the plug assembly in an axial and/or radial direction. The thickness of the retaining lip of the shear ring is calibrated through testing of multiple samples.

The shear ring can be made out of a multitude of materials including red brass, naval brass and other brass alloys, bronze and bronze alloys. However, it is also possible to be made out of 13% Chrome, Super 13% Chrome, 25% Chrome, Inconel 625 and Inconel 718.

Through the above indicated release process, the shear ring will be subjected to both bending and shearing forces, where this will limit the shear ring's accuracy as a calibrated release mechanism. This could result in the plug assembly not being opened at the desired time and/or that an additional pressure must be applied to the surface of the plug assembly in order to open it.

Thus, there is a need for plug assemblies comprising frangible materials that can be opened by controlled application of pressure from above the plug assembly. It is therefore an object of the present invention to provide a plug assembly comprising a plug that can hold pressure while being used for its purpose, and then be safely and completely opened after it has served its purpose with a mechanism for breaking the plug that is strong enough to support the frangible material and able to, with a specific, preset pressure value and in a controlled and predictable manner, break the frangible material with a breaker.

Furthermore, another object of the present invention is to provide a plug assembly where the plug assembly is opened with a specific, preset pressure value, the preset pressure value being predictable and repeatable. The tensile release mechanism allows for a narrower tolerance of release pressures than is currently available. The plug assembly in accordance with the present invention does provide these advantages. Additionally, advantages can be readily understood by one skilled in the art.

The tensile release mechanism comprises of a cylindrical object wherein the cross-sectional area changes along its length. Load is applied to the tensile release mechanism, with a component of the force in the axial direction, causing it to stretch and eventually break into two or more pieces. The load applied can either be due to an element arranged transverse to the tensile release mechanism or an element arranged axial to the tensile release mechanism. Load can also be applied in a combination of both. The thickness of the tensile release mechanism is adjusted to a predetermine axial load.

The tensile release mechanism proposed can be made to respond to tighter threshold tolerances and increase the reliability of the device operation. It can also be made of the same materials as the others in the assembly.

SHORT SUMMARY OF THE INVENTION

A plug assembly is arranged in a housing for use in a downhole tool including: a glass assembly including a plug; a seat arranged to support the plug; a breaker object arranged to break the plug upon contact with the plug; and a tensile release mechanism including: a tensile body; a tensile element; wherein: the tensile element is arranged along the tensile body; the tensile release mechanism arranged to break at the tensile element at an applied threshold tensile force; wherein: the plug assembly is arranged to have a first position and a second position, in the first position, the plug is intact and fluid flow through the plug assembly is blocked, and in the second position, the plug assembly is arranged such that after a threshold pressure has been applied to the plug assembly, the seat moves with the respect to the breaker object, the tensile element is broken, and the plug is broken by the breaker object; and pressure applied to the plug is arranged to apply a tensile force to the tensile release mechanism.

In an example of a plug assembly, the element is arranged to break in a direction transverse to the applied threshold tensile force. In an example of a plug assembly, axial movement of the seat causes the tensile release mechanism to break. In an example of a plug assembly, the tensile release mechanism supports the seat in the first position. In an example of a plug assembly, the tensile release mechanism supports the breaker object.

In an example of a plug assembly, the tensile body includes: a first tensile body part and a second tensile body part separated by the tensile element, wherein the first tensile body part is fixed to the housing and the second tensile body part supports the seat in the first position.

In an example of a plug assembly, the tensile body includes a tensile shoulder, and the seat includes a seat body, and the seat body includes a seat shoulder; wherein: the tensile shoulder is in contact with the seat shoulder.

In an example of a plug assembly, the tensile element is thinner than the tensile body. In an example of a plug assembly, the tensile release mechanism is made of the same material as the seat.

In an example of a plug assembly, the tensile release mechanism includes a number of tuning areas arranged on the tensile element, wherein the number of tuning areas have a different thickness than the tensile element.

In an example of a plug assembly, the tuning areas are through the tensile element. In an example of a plug assembly, a snap ring is arranged in a snap ring pocket in the housing, and the seat includes: a seat body, and a seat pocket arranged on the seat body; wherein: the snap ring enters the seat pocket and locks the seat in place in the second position.

In an example of a plug assembly, the breaker object is arranged in a breaker holder in the tensile release mechanism. In an example of a plug assembly, the tensile element includes a groove.

A tensile release mechanism for use in a plug assembly, including: an annular shaped tensile body; a tensile element arranged on the tensile body; wherein: the tensile release mechanism is arranged to break at the tensile element when a threshold tensile force is applied to the tensile release mechanism; and the tensile element is thinner than the tensile body.

In an example of a tensile release mechanism, the tensile body includes: a first tensile body part and a second tensile body part separated by the tensile element, wherein: an outer surface of the first tensile body part is arranged to be in contact with a first element, and an inner surface of the second tensile body part is arranged to be in contact with a second element.

In an example of a tensile release mechanism, the tensile element includes a groove. In an example of a tensile release mechanism, the second tensile body part includes a tensile shoulder and the second element is in contact with the tensile shoulder.

In an example of a tensile release mechanism, the tensile body includes a number of tuning areas arranged on the tensile element, wherein the number of tuning areas have a different thickness than the tensile element. In an example of a tensile release mechanism, the number of tuning areas are through the tensile element.

BRIEF DESCRIPTION OF THE FIGURES

The above and further features of the invention are set forth with particularity in the appended claims and advantages thereof will become clearer from consideration of the following detailed description. Embodiments of the present invention will now be described, by way of example only, with reference to the following diagrams wherein:

Figure 1:
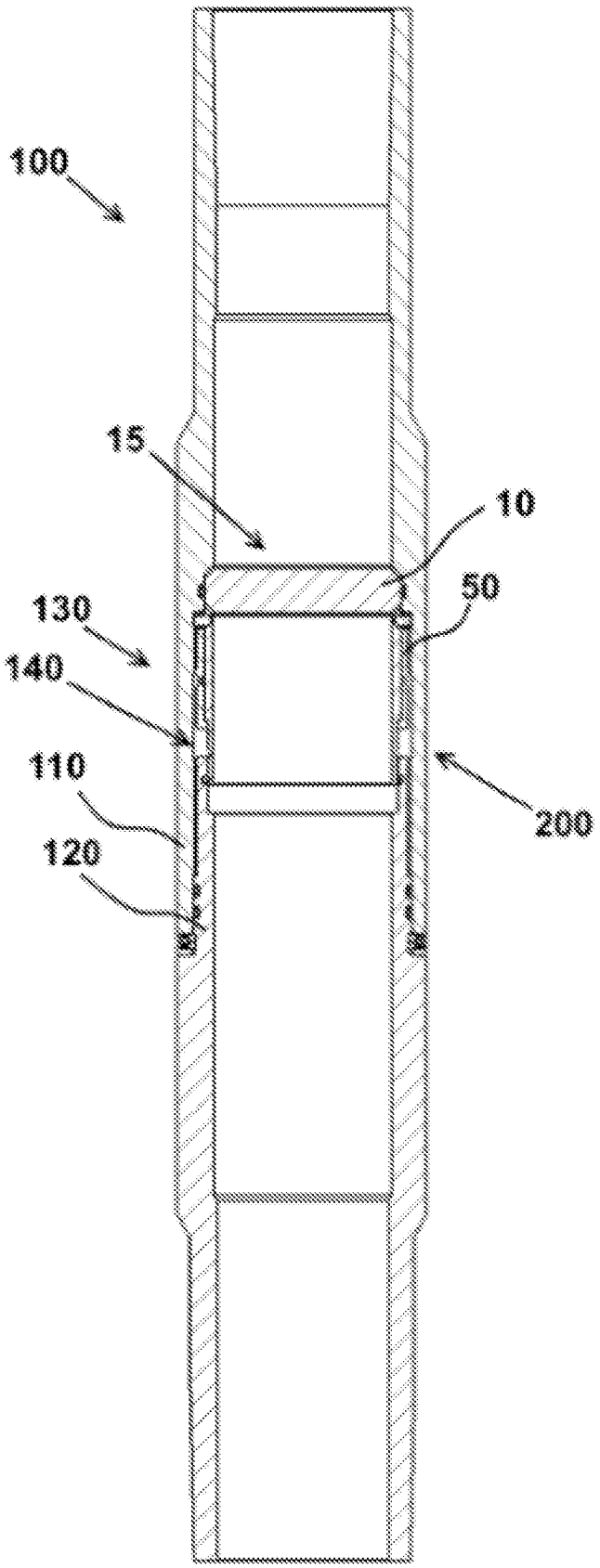
FIG. 1 discloses a side view of a longitudinal cross section of an example of a plug tubular with a tensile release mechanism in an initial position.

| Reference numbers and corresponding elements | |
|---|---|
| Text | Label |
| Plug | 10 |
| Sealing Element | 11 |
| Sealing Area | 13 |
| Bearing Ring | 14 |
| Glass Assembly | 15 |
| Seat | 20 |
| Seat Body | 21 |
| Breaker Pocket | 22 |
| Seat Pocket | 23 |
| Seat Shoulder | 24 |
| Breaker Object | 30 |
| Breaker Holder | 31 |
| Snap Ring | 40 |
| Snap Ring Pocket | 41 |
| Tensile Release Mechanism | 50 |
| Tensile Body | 51 |
| First Tensile Body Part | 51a |
| Second Tensile Body Part | 51b |
| Tensile Element | 52 |
| Groove | 52B |
| Tensile Shoulder | 53 |
| Tuning Areas | 54 |
| Plug Tubular | 100 |
| Upper Tubular | 110 |
| Tubular Body | 130 |
| Housing | 140 |
| Plug Assembly | 200 |

DETAILED DESCRIPTION OF THE INVENTION

Reference will now be made in detail to the present embodiments of the invention, examples of which are illustrated in the accompanying figures. Alternative embodiments will also be presented. The figures are intended to be read in conjunction with both the summary, the detailed description, and any preferred and/or particular embodiments, specifically discussed or otherwise disclosed. This invention may, however, be embodied in many different forms and should not be construed as limited to the embodiments set forth herein. These embodiments are provided by way of illustration only. Several further embodiments, or combinations of the presented embodiments, will be within the scope of one skilled in the art. As described, there are various ways to open plugs. In the examples given below, the plugs are opened applying pressure, which brings a breaker object 30 into contact with the plug 10, causing it to break. The breaker object 30 does not have to be operated in this manner. Instead, applied pressure or a different kind of signal such as that provided by a control line could cause the breaker object 30 to be brought into contact with the plug 10 to break it. In some cases a ball could be dropped on the plug. In some cases, an explosive will be used as the breaker object 30, with the resultant explosion breaking the plug 10. Alternatively, the plug 10 may be designed to be broken by milling it open. The plug 10 could then be arranged in a glass assembly 15 and said glass assembly 15 could be directly secured in a housing 140 of a plug tubular 100.

Plugs that can be opened using pressure, operate upon the principle of a plug 10 arranged in a housing 140 of a plug tubular 100. The plug 10 is part of a glass assembly 15 which prevents fluid connection between an upper tubular 110 on an upstream side of the plug 10 and a lower tubular 120 on a downstream side of the plug. A glass assembly 15 comprises the plug 10 and is arranged on a seat 20 for support. Pressure is applied to one side of the plug (normally from the upstream side). At a predetermined absolute pressure, or a predetermined differential pressure, the plug 10 breaks.

One common way is that the predetermined pressure causes the seat 20 to move in an axial manner until the plug 10 contacts a breaker object 30. Upon contact, the plug 10 will disintegrate, and flow through the plug tubular 100 is restored. The sealing area 13 is the area or areas where it is fluid tight between the plug 10 and the tubular body 130 and/or the plug 10 and the seat 20. As pressure from the top causes them to break, this is commonly referred to as a pump open type plug. It is also possible to open the plug 10 with by applying pressure from below, e.g. a so-called surge open type plug.

Also note that a plug assembly 200 may be used in a casing, a liner, a tubing, or any other metal pipes used downhole, with any outer and inner diameters.

FIG. 1 discloses a side view of a longitudinal cross section of a plug tubular 100. The plug tubular 100 comprises a plug assembly 200 arranged in a housing 140 in a tubular body 130. The tubular body 130 comprises an upper tubular 110 on the upstream side of the plug 10 and a lower tubular 120 on the downstream side of the plug 10.

The plug assembly 200 comprises a glass assembly 15 and a tensile release mechanism 50. The glass assembly 15 comprises a plug 10. The plug 10 provides a fluid barrier between the uphole and downhole side of the plug tubular 100. The plug 10 prevents fluid connection between the fluid inside the upper tubular 110 on the upstream side of the plug and the fluid on the downstream side of the plug inside the lower tubular 120.

The plug assembly 200 is arranged such that during operation there are three positions. In an initial position, both the plug 10 and the tensile release mechanism 50 are intact. In an intermediate position, the plug 10 is intact and the tensile release mechanism 50 is not intact. In a final position, the plug 10 has been broken. This will be discussed in detail below.

Note that while glass assembly 15 is called a "glass assembly" it refers to the element that contains the plug 10, regardless of material (including non-glass materials).

The tubular body 130 in the example shown is comprised of an upper tubular 110 connected to a lower tubular 120 in appropriate ways, for instance through a threaded connection, welded joint or the like. In some cases, the tubular body 130 may be made of a single piece or more than two pieces.

Figure 2A:
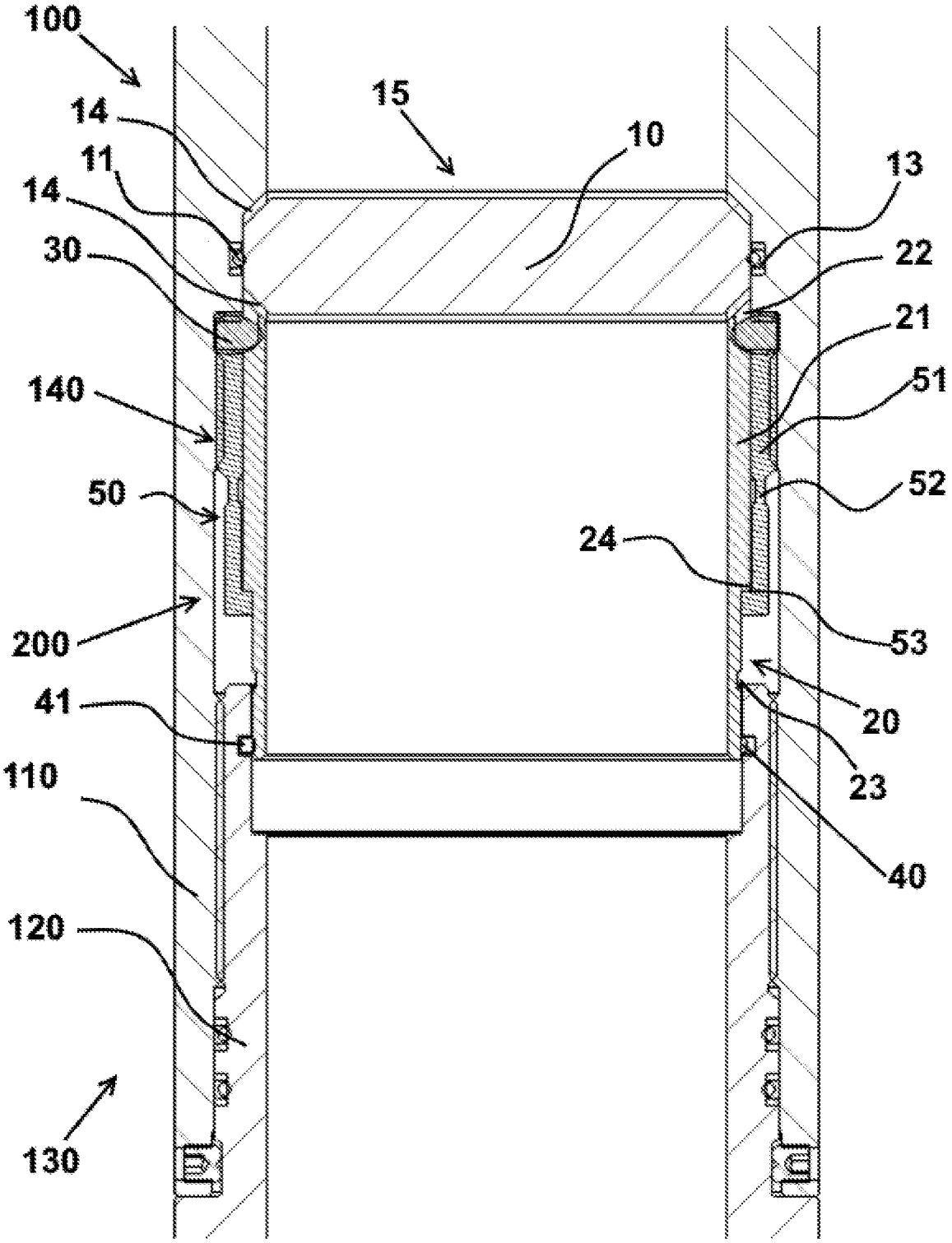
FIG. 2A discloses an example of a plug assembly with a tensile release mechanism in an initial position during operation.
Figure 2B:
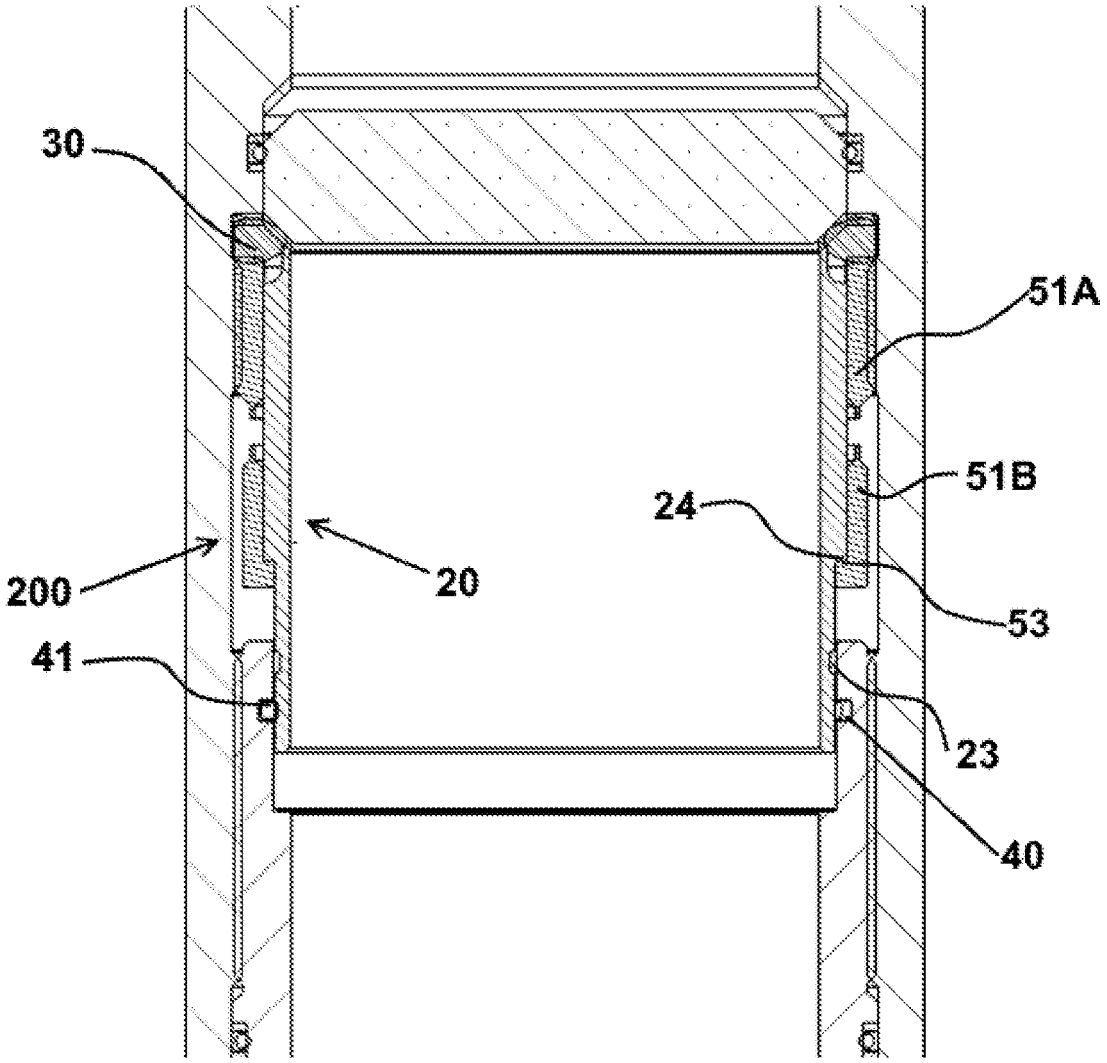
FIG. 2B discloses the plug assembly of FIG. 2A with the tensile release mechanism in an intermediate position during operation.
Figure 2C:
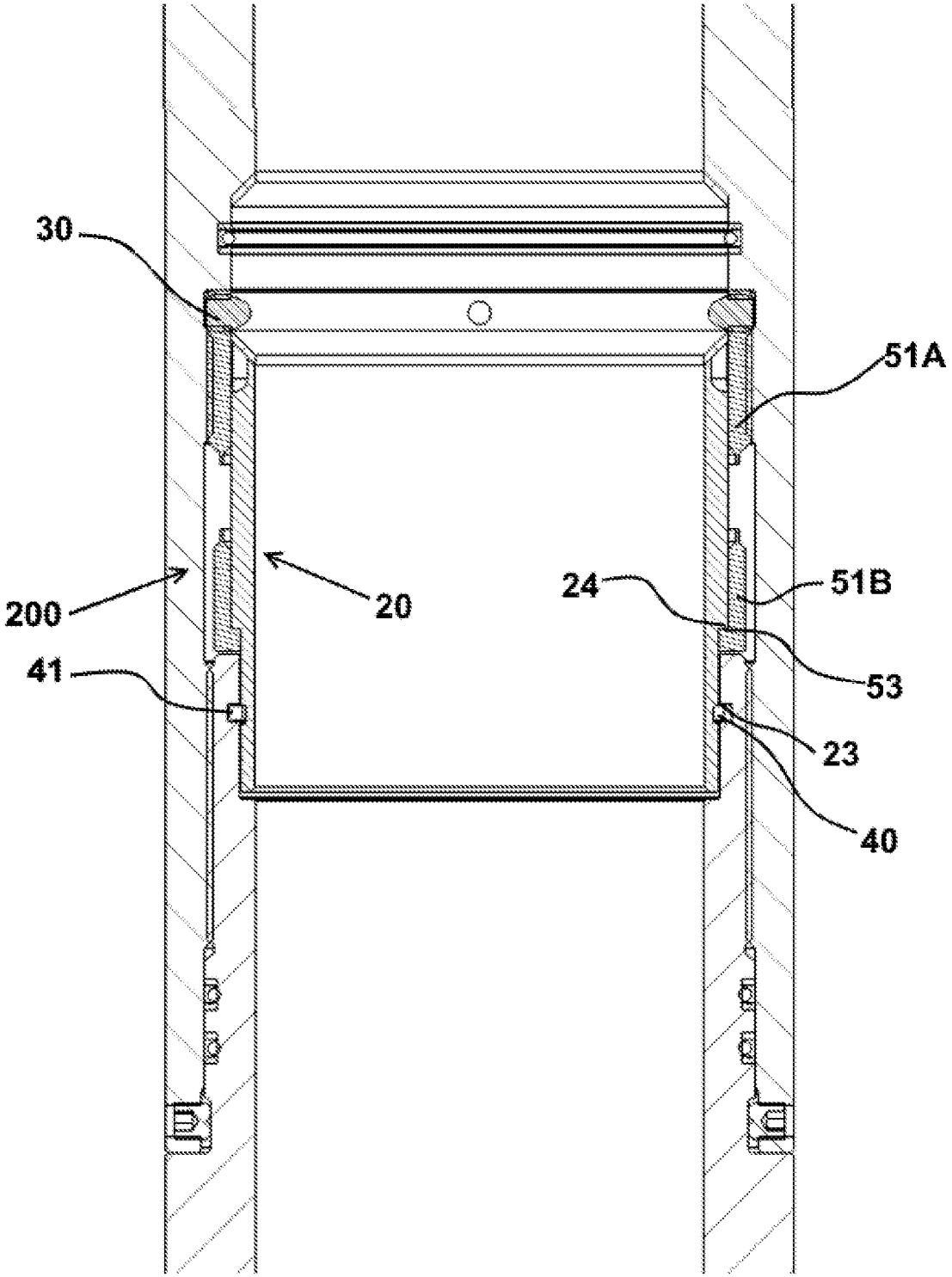
FIG. 2C discloses the plug assembly of FIG. 2A with the tensile release mechanism in a final position during operation.

FIGS. 2A-2C disclose an example of the plug assembly 200 with a tensile release mechanism 50 during operation. The plug assembly 200 comprises a glass assembly 15, a seat 20, a breaker object 30, and a tensile release mechanism 50. FIG. 2A discloses the plug assembly 200 in the initial position where the tensile release mechanism 50 is intact and the glass assembly 15 is not in motion. The glass assembly 15 comprises a plug 10, bearing ring 14, and a sealing element 11. The glass assembly 15 is arranged on a seat 20. The seat 20 is supported by the tensile release mechanism 50.

At a predetermined threshold pressure, whether an absolute or differential pressure depends on the application, on the plug assembly 200, the tensile release mechanism 50 breaks because it meets or exceeds a threshold tensile force on the tensile release mechanism 50. The breaking of the tensile release mechanism 50 allows the seat 20 to move in an axial manner until the plug 10 contacts a breaker object 30. Upon contact with the breaker object 30 the plug will break and flow through the plug tubular 100 (and plug assembly 200) is restored.

The tensile release mechanism 50 comprises a tensile body 51. The tensile body 51 comprises a first tensile body part 51A and a second tensile body part 51B. In the example disclosed, the first tensile body part 51A is affixed in appropriate ways to the housing 140 of the plug tubular 130 and the second tensile body part 51B supports the seat 20. Between the first tensile body part 51A and the second tensile body part 51B is arranged a tensile element 52. The tensile element 52 will normally be an area of the tensile body 51 which is thinner. It is at the tensile element 52 that the tensile release mechanism 50 will break. The seat 20 comprises a seat shoulder 24 that is arranged to contact a tensile shoulder 53 provided on an inner side of the tensile body 51. In this way, force on the seat 20 will apply a stretching force (tensile force) to the tensile release mechanism 50 when the seat 20 moves axially within the plug tubular 130. When a threshold tensile force is applied to the tensile release mechanism, it is great enough to stretch the tensile element 52 until it breaks. Once the tensile element 52 breaks, the plug assembly 200 moves from a first, through the second, and into the final position.

As discussed previously, the tensile release mechanism 50 is arranged to break due to a tensile force (a force that stretches the tensile release mechanism 50). In this example, the tensile body 51 is stretched until it breaks at the tensile element 52 into the first tensile body part 51A and second tensile body part 51B. The break of the tensile element 52 is transverse to the tensile body 51.

Note that a shear ring would not have broken in this manner. A shear ring is designed to break at an interface due to shear forces, not tensile ones. A shear ring shaped like the tensile release mechanism 50 shown would have sheared at the interface between the second tensile body 51B and the tensile shoulder 53. The glass assembly 15 comprises a plug 10, a sealing element 11, and two bearing rings 14. The sealing element 11 prevents fluid from traveling around the plug 10. In the example shown, this is found between the plug 10 and the housing 140 on one side and the plug 10 and the seat 20 on the other side. A bearing ring 14 is arranged between the plug 10 and the housing 140 one side and the plug 10 and the seat 20 on the other side. A common example of a sealing element 11 is an O-ring. The sealing area 13 is the area on the housing 140 and seat 20 that is in contact with the sealing element 11. It is this area which accounts for the plug 10 being fluid tight. The sealing element 11 could be arranged on the outside of the plug 10, in a groove in the plug 10, or a groove in the housing 140 and/or seat 20. As will be disclosed below, it is also possible for other elements to be fluid tight as well. Those elements will further contribute to the sealing area 13, but often the main seal is formed by the sealing element 11. The sealing area 13 does not include the areas in which a fluid tight seal is not provided.

The main purpose of the bearing ring 14 is to help reduce the possibility of contact between the plug 10 and hard metal surfaces (e.g. the housing 140 and the seat 20). At higher pressures, contact between a hard metal surface and the plug 10 could result in a premature, unwanted and/or uncontrolled breaking of the plug 10. Common materials for bearing rings 14 are soft enough to provide cushioning between the plug 10 and adjacent hard components, such as the seat 20 or housing 140, thus preventing premature breaking of the plug. An example of such materials are soft metals, rubber, or plastics, preferably PEEK.

A breaker object 30 is arranged to break the plug 10 when they make contact. In the example shown, the breaker object 30 is by the tensile release mechanism 50 in a breaker holder 31. It is also possible for the breaker object 30 to be directly affixed to housing 140.

The glass assembly 15 is supported by the seat 20. The plug 10 will be directly or indirectly supported by a topmost portion of the seat 20, the seat body 21. When the seat 20 moves in an axial direction within the housing 140 of the tubular body 130, the plug 10 will move with it. In the example shown, the seat 20 has a breaker pocket 22 that is arranged such that the breaker object 30 pass through the seat 20. The seat 20 has a seat pocket 23.

In order to prevent the seat 20 from moving back toward the initial position once the plug 10 has broken, a snap ring 40 may optionally be used. The snap ring 40 is tensioned to expand and is arranged in a snap ring pocket 41. The snap ring pocket 41 is arranged in the housing 140 (in this specific example, a part of the lower tubular 120). A seat pocket 23 is arranged on the seat body 21 of the seat 20. In the final position, the snap ring 40 of will expand into this seat pocket 23 and lock the seat 20 into place.

FIG. 2B discloses the plug assembly 200 in an intermediate position where the tensile release mechanism 50 has broken at the tensile element 52 after a threshold pressure has been applied to the plug assembly 200 (usually to the plug 10), the seat 20 has moved axially within the housing 140 of the tubular body 130, but the plug 10 is still intact. The first tensile body part 51A remains in place, but the second tensile body part 51B continues to move. As seat 20 is being supported by the second tensile body part 51B, the seat 20 will move and the plug 10 will eventually make contact with the breaker object 30. FIG. 2C discloses the plug assembly 200 in a final position where the plug 10 has broken because of the breaker object 30 and fluid can now flow through the plug assembly 200. In the final position, the seat 20 has moved axially so far that the seat pocket 23 provided in the seat 20 is aligned with the snap ring 40 arranged in the snap ring pocket 41, whereby the snap ring 40 has entered the seat pocket 23 and is preventing the seat 20 from further movement. The examples disclosed in the figures show a seat shoulder 24 of the seat 20 in contact with a tensile shoulder 53 of the tensile release mechanism 50, however these are not required. What is important is that when it is time to move the plug assembly 200 from the initial position to the final position, a portion of the tensile release mechanism 50 is fixed with respect to the housing 140 and another portion provides support to the seat 20. The figures perform this using a mating shoulder. However, this may also be done by affixing the seat 20 to the tensile release mechanism 50 (e.g. bolting or welding). The force from the seat 20 will then be transmitted to the tensile release mechanism 50 as a tensile stress.

The tensile release mechanism 50 holds the breaker object 30, i.e. it acts as the breaker holder 31, in this example, but the breaker object 30 could be mounted in a separate assembly or directly in the housing 140.

The tensile element 52 is shown as in the middle of the tensile body 51 (dividing it into the first tensile body part 51A and the second tensile body part 51B), however this is not the only possible configuration. For example, the tensile element 52 could be near or at the end of the tensile body 51 rather than in the middle. This could allow for the tensile body 51 to be attached directly to the seat 20, thereby acting like a tensile shoulder. A single tensile release mechanism 50 could be comprised of multiple tensile body 51 elements separated by tensile elements 52.

At higher temperatures and/or pressures, elastomeric materials (e.g. rubber) might no longer be suitable as a bearing ring 14. The conditions can make it possible for an elastomeric material to be squeezed out of form between the plug 10 and a metal surface. such that there is not enough support of the plug 10 or metal to metal contact between the plug 10 and another element of the plug assembly 200 or the plug tubular 100. In these cases, it may be needed to use a non-elastomeric bearing ring.

Depending upon operating conditions and material composition concerns, it may be possible for the glass assembly 15 to include a plug 10 and a single sealing element 11 and/or a single bearing ring 14.

Figure 3A:
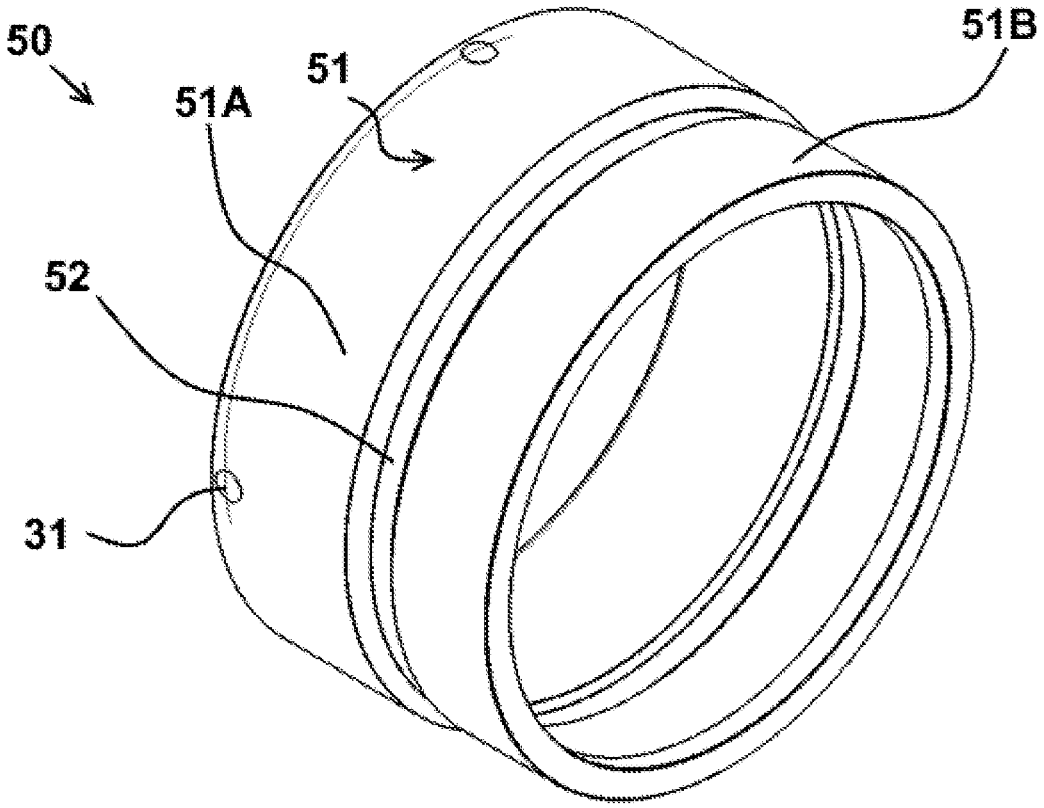
FIG. 3A discloses a first view of an exemplary tensile release mechanism.
Figure 3B:
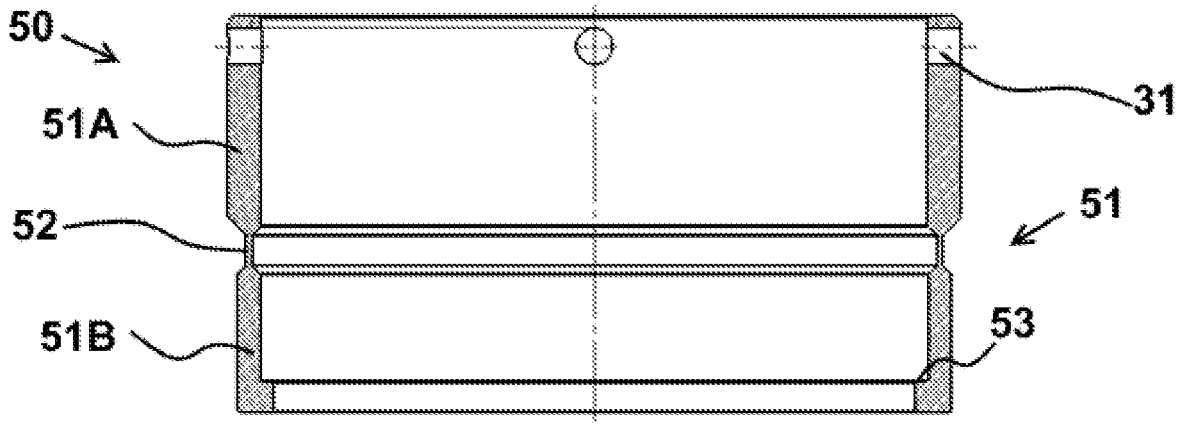
FIG. 3B discloses a second view of the exemplary tensile release mechanism of FIG. 3A.
Figure 3C:
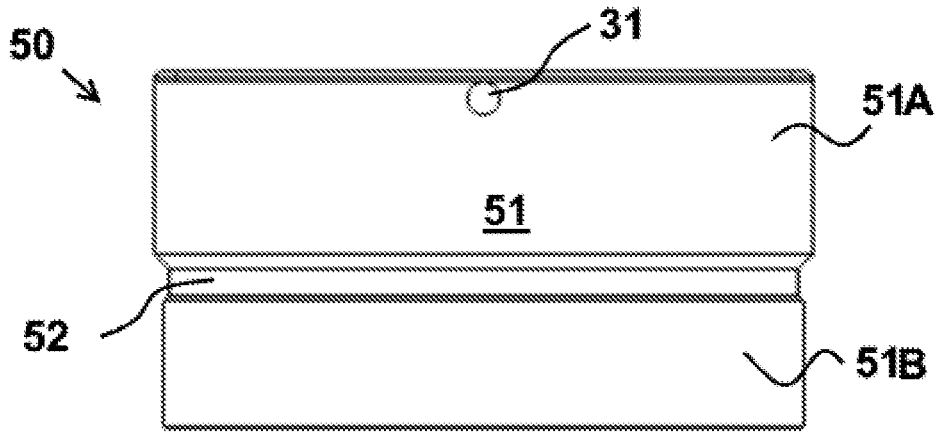
FIG. 3C discloses a third view of the exemplary tensile release mechanism of FIG. 3A.

FIGS. 3A-3C disclose different views of an example of a tensile release mechanism 50. A tensile body 51 comprises a first tensile body part 51A and a second tensile body part 51B, with a tensile element 52 arranged between them. The tensile element 52 is narrower than the tensile body 51. In this manner, the tensile element 52 requires less tensile force to break than the tensile body 51.

The example of a tensile release mechanism 50 disclosed in these figures has holes to act as a breaker holder 31. The breaker holder 31 is an element in the plug assembly 200 that keeps the breaker object 30 in place during operation of the plug assembly 200. The breaker object 30 is inserted into the tensile release mechanism 50 before installation of the plug assembly 200 into the housing 140. This is not a requirement as the mounting of the breaker object 30 and the behavior of tensile release mechanism 50 does not need to be related.

During operation, the seat 20 (not shown in FIGS. 3A-3C) is arranged such that a tensile force is applied to the tensile release mechanism 50. A discussion of this was presented previously. The seat shoulder 24 (not shown) rests upon the tensile shoulder 53 of the tensile release mechanism 50, the tensile shoulder 53 being provided on an inside of the tensile release mechanism 50. In the example shown, the tensile shoulder 53 is arranged on the second tensile body part 51B. In this way, force from the seat 20 applies a tensile force to the tensile release mechanism 50. Eventually the force from the seat 20 will be high enough that the tensile release mechanism 50 breaks at the tensile element 52 and the tensile body 51 divides into a first tensile body part 51A and a second tensile body part 51B. A portion of the tensile release mechanism 50 (normally the first tensile body part 51A) is fixed with respect to the housing 140 (not shown in FIGS. 3A-3C) with the second tensile body part 51B able to move once the tensile element 52 has broken.

As can be seen from FIGS. 3A-3C, the tensile release mechanism 50 can also be provided with one or more breaker holders 31, the breaker holder being a throughgoing opening, and one or more tuning areas 54, where the one or more tuning areas 54 being a throughgoing hole.

Figure 4A:
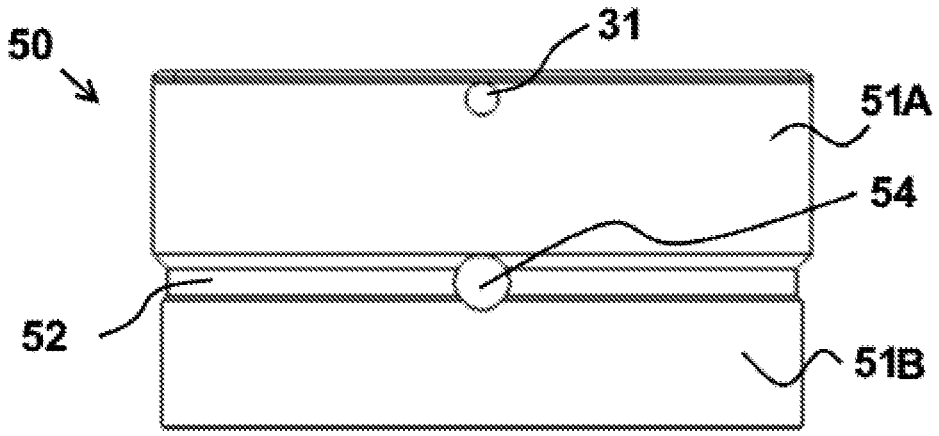
FIG. 4A discloses an exemplary tensile release mechanism including tuning areas.
Figure 4B:
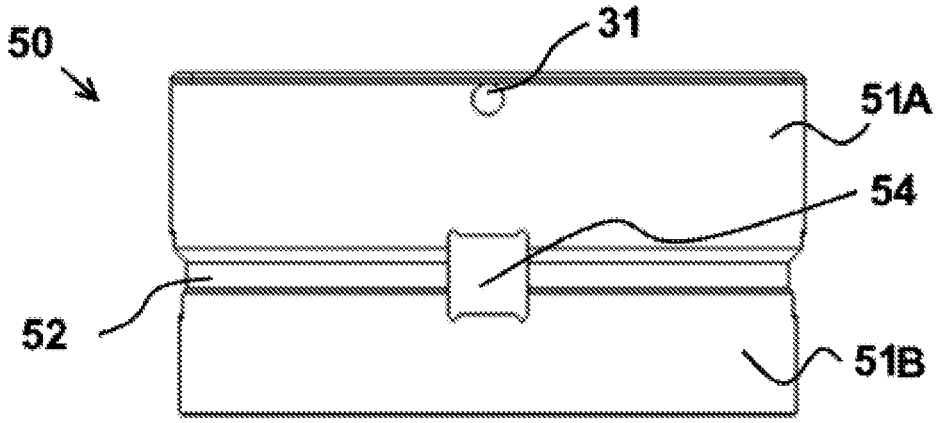
FIG. 4B discloses another exemplary tensile release mechanism including tuning areas.
Figure 4C:
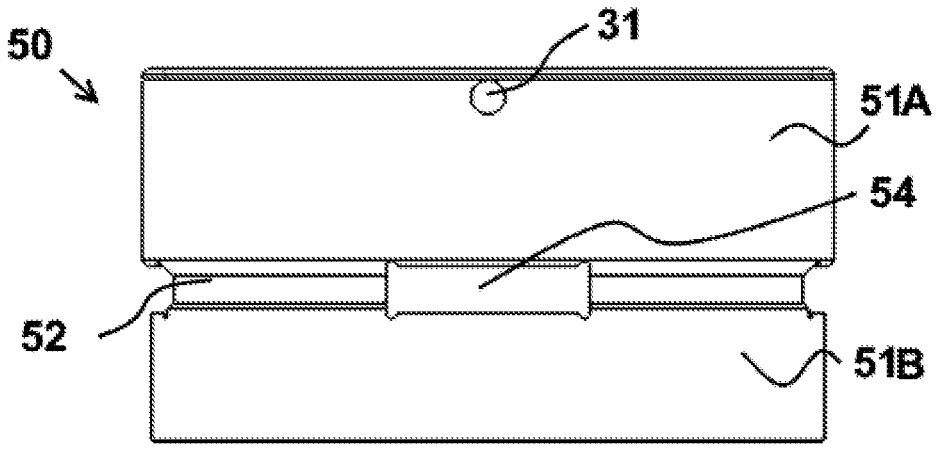
FIG. 4C discloses a further exemplary tensile release mechanism including tuning areas.

FIGS. 4A-4C discloses examples of a tensile release mechanism 50 including tuning areas 54. In FIG. 4A, the tuning areas 54 is a through hole, in FIG. 4B, the tuning areas 54 is a square cutout, and in FIG. 4C, the tuning areas 54 is a rectangle. There are several ways to adjust the force that causes the tensile release mechanism 50 to break. One way is by adjusting the thickness of the tensile element 52 or changing the type of material the tensile release mechanism 50 (or tensile element 52) it is made of. Another way is to use tuning areas 54 where the thickness of the tensile element 52 in a specific area is changed. In the disclosed examples, these tuning areas 54 are areas where the tensile element 52 has been entirely removed. It is also possible to only thin the area or add material or use a different material. By adjusting the tuning areas 54, it is possible finely adjust the amount of force required to break the tensile release mechanism 50.

Depending upon the material type and thickness, the use of tuning areas 54 may be more reliable than by changing the thickness of the tensile element 52 alone. While the glass assembly 15 disclosed in the figures has two bearing rings 14, one on each side of the plug 10, this is not always needed. For example, a single bearing ring 14 may be sufficient. If the plug assembly 200 was designed to only deal with pressure from the uphole side, then a single bearing ring 14 on the downhole side of the plug 10 could be enough. In some cases, a bearing ring 14 is unnecessary as the plug 10 can tolerate contact with metal and not break prematurely.

The sealing element 11 is disclosed in the figures at the middle portion of the plug 10 and sealing against the parallel side of the wall of the housing 140. This is not a requirement either. The sealing element 11 could be moved or eliminated. In the examples shown in the figures, the pressure applied to the plug assembly 200 are experienced by the plug 10. It is possible that other parts of the plug assembly 200 could be experiencing this pressure instead. In some systems, e.g. explosive systems, the plug 10 doesn't move.

Figure 5:
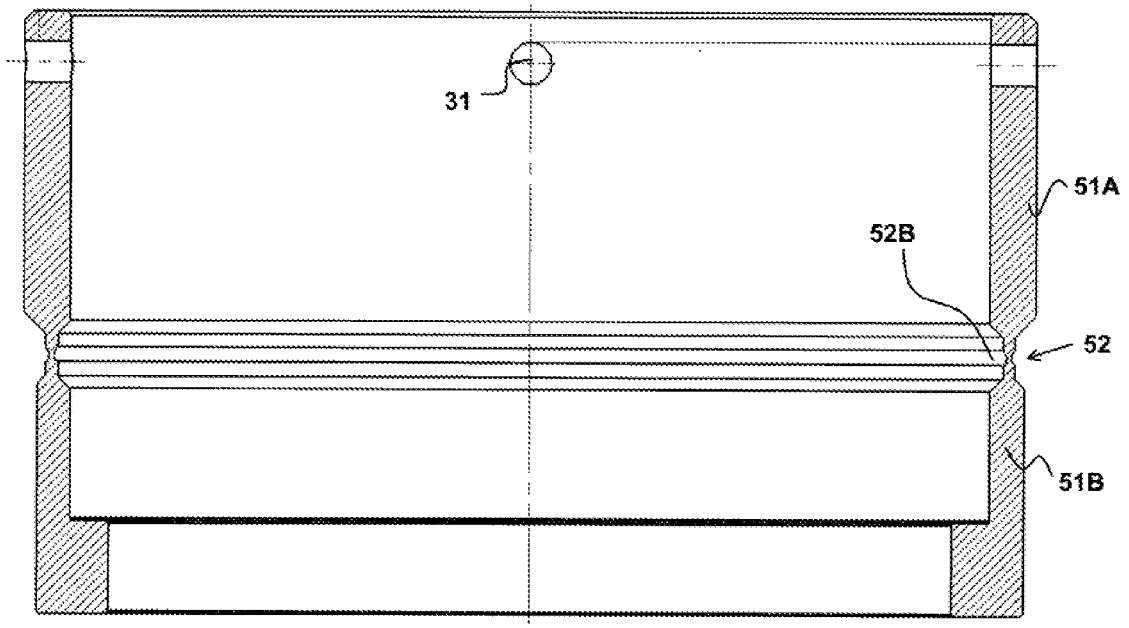
FIG. 5 discloses an exemplary tensile release mechanism in greater detail.
Figure 6A:
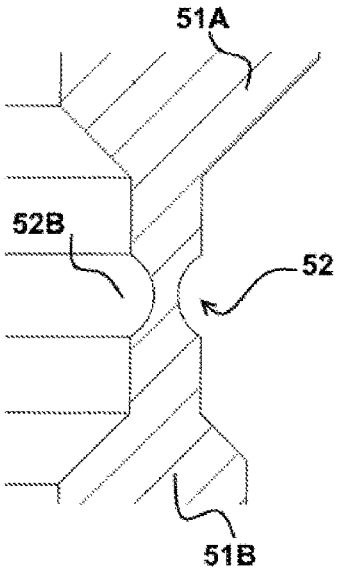
FIG. 6A discloses an exemplary groove shape of the tensile release mechanism.
Figure 6B:
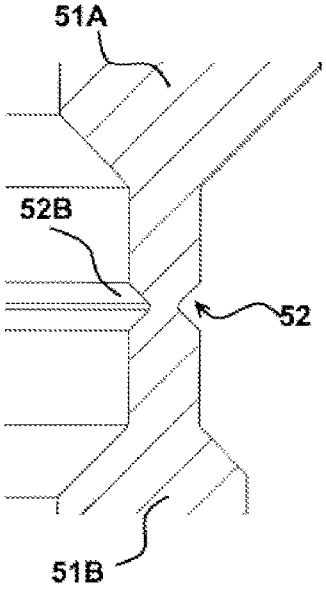
FIG. 6B discloses another exemplary groove shape of the tensile release mechanism.
Figure 6C:
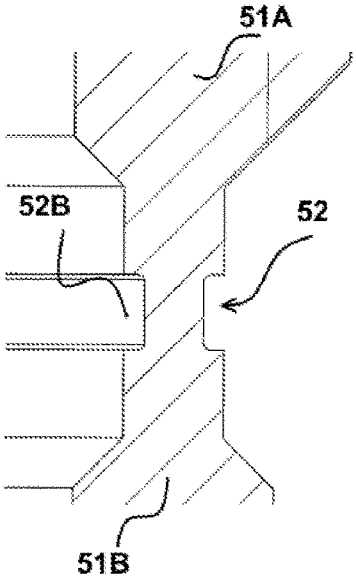
FIG. 6C discloses a further exemplary groove shape of the tensile release mechanism.

FIG. 5 discloses examples of a tensile release mechanism 50 in greater detail, where the tensile element 52 is arranged between the first tensile body part 51A and the second tensile body part 51B. The tensile element 52 is thinner than the first tensile body part 51A and the second tensile body part 51B. In this example the tensile element of the 52 is provided with a groove 52B around the tensile element 52. FIGS. 6A-6C discloses examples of different groove 52B shapes in the tensile element 52. The groove 52B may, as seen in FIG. 6A, have a rounded form, a V-form as seen in FIG. 6B, or a squared form as in FIG. 6C. Each of these groove 52B shapes allow another way to the tune the tensile force needed to break the tensile release mechanism 50 at the tensile element 52.

The tensile element 52 of the tensile release mechanism 50 is then provided with a thickness and a form that will create an area with high stress concentration in order to fail at this location.

In the examples disclosed in the figures, the breaker object 30 remains fixed in place when the plug 10 moves axially (in this example when the seat 20 moves axially when the tensile release mechanism 50 receives sufficient force). This is due to pressure on the plug 10 applying force to the seat 20 and the seat 20 being able to transfer force to the tensile release mechanism 50. Eventually the pressure on the seat will be sufficient to break the tensile release mechanism 50. It would be possible for the tensile release mechanism 50 to break due to a force other than that from the plug 10 on the seat 20. In this way, it is not required that the pressure on the seat 20 lead to breaking of the tensile release mechanism.

For example, the force sufficient on the tensile release mechanism 50 to cause breakage can be applied to the tensile release mechanism 50 directly (rather than the by the seat 50). An example of this is using a dropped ball or dart to impact the tensile release mechanism 50 directly. Another method would be to have a portion of the tensile release mechanism 50 that is within the tubular that experiences the forces (due to pressure or actuation of another element) sufficient to break the tensile release mechanism 50. These examples could be applied in the case where the breaker object 30 or the plug 10 moves.

However, this is not the only way to use the tensile release mechanism 50 to break the plug 10. It is the relative motion between the breaker object 30 and the plug 10 that is important. It is possible for both the breaker object 30 and the plug 10 to move, or only the breaker object 30 moves, or only the plug 10 moves. In an example, the plug 10 is stationary and the breaker object 30 is arranged to move after the tensile release mechanism 50 breaks. Examples of the ways that the tensile release mechanism 50 can be caused to break without the force on the seat has been discussed previously. Another example would be that the breaker object 30 could be directly or indirectly connected to the tensile release mechanism 50. Please note that "step of" is not to be interpreted as "step for". By "comprised of", "comprising", "comprises" etc. we are referring to an open set and by "consisting of" we are referring to a closed set.

Modifications to the embodiments previously described are possible without departing from the scope of the invention as defined by the accompanying claims. Numerals included within parentheses in the accompanying claims are intended to assist understanding of the claims and should not be construed in any way to limit the subject matter claimed. Reference to the singular is also to be construed as relating to the plural unless expressly stated otherwise. Any reference numbers in the claims are provided as a courtesy and are not to be interpreted as limiting the claim in any way.

It is hereby claimed:

1. A plug assembly (200) arranged in a housing (140) for use in a downhole tool comprising:
- a glass assembly (15) comprising a plug (10);
- a seat (20) arranged to support the plug (10);
- a breaker object (30) arranged to break the plug (10) upon contact with the plug (10); and a tensile release mechanism (50) comprising:
- a tensile body (51);
- a tensile element (52);
- wherein:
- the tensile element (52) is arranged along the tensile body (51);
- the tensile release mechanism (50) arranged to break at the tensile element (52) at an applied threshold tensile force;
- wherein:
- the plug assembly (200) is arranged to have a first position and a second position,
- in the first position, the plug (10) is intact and fluid flow through the plug assembly is blocked, and
- in the second position, the plug assembly (200) is arranged such that after a threshold pressure has been applied to the plug assembly (200), the seat (20) moves with the respect to the breaker object (30), the tensile element (52) is broken, and the plug (10) is broken by the breaker object (30); and
- pressure applied to the plug (10) is arranged to apply a tensile force to the tensile release mechanism (50); and
- wherein the tensile body (51) further comprises:
- a first tensile body part (51A) and a second tensile body part (51B) separated by the tensile element (52),
- wherein the first tensile body part (51A) is stationary with respect to the housing (140) between the first and second position and the second tensile body part (51B) supports the seat (20) in the first position; and
- wherein the breaker object (30) is arranged in a breaker holder (31) in the tensile release mechanism (50).

2. The plug assembly (200) according to claim 1, wherein the tensile element (52) is arranged to break in a direction transverse to the applied threshold tensile force.

3. The plug assembly (200) according to claim 1,
- wherein the first tensile body part (51A) is fixed to the housing (140).

4. The plug assembly (200) according to claim 1, wherein:
- the tensile body (51) further comprises a tensile shoulder (53), and
- the seat (20) further comprises a seat body (21), and the seat body (21) comprises a seat shoulder (24);
- wherein: the tensile shoulder (53) is in contact with the seat shoulder (24).

5. The plug assembly (200) according to claim 1, wherein the tensile element (52) is thinner than the tensile body (51).

6. The plug assembly (200) according to claim 1, wherein a snap ring (40) is arranged in a snap ring pocket (41) in the housing (140), and
- the seat (20) further comprises:
- a seat body (21), and
- a seat pocket (23) arranged on the seat body (21);
- wherein:
- the snap ring (40) enters the seat pocket (23) and locks the seat (20) in place in the second position.

7. The plug assembly (200) according to claim 1, wherein the tensile element (52) further comprises a groove (52B).

8. A plug assembly (200) arranged in a housing (140) for use in a downhole tool comprising:
- a glass assembly (15) comprising a plug (10);
- a seat (20) arranged to support the plug (10);
- a breaker object (30) arranged to break the plug (10) upon contact with the plug (10); and a tensile release mechanism (50) comprising:
- a tensile body (51);
- a tensile element (52);
- wherein:
- the tensile element (52), is arranged along the tensile body (51);
- the tensile release mechanism (50) arranged to break at the tensile element (52) at an applied threshold tensile force;
- wherein:
- the plug assembly (200) is arranged to have a first position and a second position, in the first position, the plug (10) is intact and fluid flow through the plug assembly is blocked, and
- in the second position, the plug assembly (200) is arranged such that after a threshold pressure has been applied to the plug assembly (200), the seat (20) moves with the respect to the breaker object (30), the tensile element (52) is broken, and the plug (10) is broken by the breaker object (30); and
- pressure applied to the plug (10) is arranged to apply a tensile force to the tensile release mechanism (50); and
- wherein the breaker object (30) is arranged within the tensile release mechanism (50); and
- wherein the tensile element (52) comprises a number of tuning areas (54) having a different thickness than the tensile element (52).

9. The plug assembly (200) according to claim 8, wherein the tuning areas (54) are through the tensile element (52).

10. The plug assembly (200) according to claim 8, wherein the tensile release mechanism (50) supports the seat in the first position.

11. The plug assembly (200) according to claim 8, wherein the breaker object (30) is arranged in a breaker holder (31) in the tensile release mechanism (50).

12. The plug assembly (200) according to claim 8, wherein the tensile element (52) is thinner than the tensile body (51).

13. The plug assembly (200) according to claim 8, wherein:

the tensile body (51) further comprises a tensile shoulder (53), and the seat (20) further comprises a seat body (21), and the seat body (21) comprises a seat shoulder (24);

wherein: the tensile shoulder (53) is in contact with the seat shoulder (24).

14. A plug assembly (200) arranged in a housing (140) for use in a downhole tool comprising:

a glass assembly (15) comprising a plug (10);

a seat (20) arranged to support the plug (10);

a breaker object (30) arranged to break the plug (10) upon contact with the plug (10); and a tensile release mechanism (50) comprising:

a tensile body (51);

a tensile element (52);

wherein:

the tensile element (52) is arranged along the tensile body (51);

the tensile release mechanism (50) arranged to break at the tensile element (52) at an applied threshold tensile force;

wherein:

the plug assembly (200) is arranged to have a first position and a second position, in the first position, the plug (10) is intact and fluid flow through the plug assembly is blocked, and in the second position, the plug assembly (200) is arranged such that after a threshold pressure has been applied to the plug assembly (200), the seat (20) moves with the respect to the breaker object (30), the tensile element (52) is broken, and the plug (10) is broken by the breaker object (30); and pressure applied to the plug (10) is arranged to apply a tensile force to the tensile release mechanism (50); and wherein the tensile body (51) further comprises:

a first tensile body part (51A) and a second tensile body part (51B) separated by the tensile element (52), wherein the first tensile body part (51A) is stationary with respect to the housing (140) between the first and second position and the second tensile body part (51B) supports the seat (20) in the first position; and wherein there is a gap between at least a portion the second tensile body part (51B) and the housing (140).

15. The plug assembly according to claim 14, wherein the tensile element (52) is thinner than the tensile body (51).

16. The plug assembly (200) according to claim 14, wherein:

the tensile body (51) further comprises a tensile shoulder (53), and the seat (20) further comprises a seat body (21), and the seat body (21) comprises a seat shoulder (24);

wherein: the tensile shoulder (53) is in contact with the seat shoulder (24).

* * * * *